US006446554B2

(12) United States Patent
Sarada

(10) Patent No.: US 6,446,554 B2
(45) Date of Patent: Sep. 10, 2002

(54) SHEET-FED PRINTING PRESS CAPABLE OF PRINTING BOTH SIDES OF A SHEET

(75) Inventor: Hiroyuki Sarada, Fuchu (JP)

(73) Assignee: Ryobi Ltd., Hiroshima-Ken (JP)

( * ) Notice: Subject to any disclaimer, the term of this patent is extended or adjusted under 35 U.S.C. 154(b) by 0 days.

(21) Appl. No.: 09/796,374

(22) Filed: Feb. 28, 2001

(30) Foreign Application Priority Data

Mar. 2, 2000 (JP) ..... 2000-056619

(51) Int. Cl.[7] ..... B41F 5/02

(52) U.S. Cl. ..... 101/230; 101/183

(58) Field of Search ..... 101/137, 140, 101/142, 145, 177, 183, 184, 217, 218, 229, 230, 246, 247

(56) References Cited

U.S. PATENT DOCUMENTS 4,120,244 A * 10/1978 Wirz ..... 101/230
4,823,695 A * 4/1989 Kida ..... 101/230
5,335,597 A * 8/1994 Helmstadter ..... 101/142
5,406,884 A * 4/1995 Okuda et al. ..... 101/137

* cited by examiner

*Primary Examiner*—Ren Yan
(74) *Attorney, Agent, or Firm*—Perkins Coie LLP

(57) ABSTRACT

A sheet-fed printing press includes stationary guide means for guiding said control cams in the axial direction of the turn-over drum, switching cam followers respectively provided on the control cams in such a manner as to protrude radially outwardly therefrom, sliders respectively forming therein camming recesses to be respectively engaged with said switching cam followers, and a slider driving means for reciprocatingly driving the sliders in such a manner as to enable the switching cam followers to reciprocatingly travel in the axial direction of the turn-over drum. The switching cam followers each travel from a first end to a second end of a corresponding one of said camming recesses along the longitudinal axis thereof for switching to the both-side printing operation, and each travel from said second end to said first end of said corresponding one of said camming recesses along the longitudinal axis thereof for switching to the single-side printing operation. The first and second ends along the longitudinal axis of each camming recess respectively have end walls adapted to press a corresponding one of said switching cam followers, so that the control cams are respectively biased against the stationary guide means in the direction substantially orthogonal to the axial direction of the turn-over drum.

5 Claims, 13 Drawing Sheets

"PRIOR ART"

"PRIOR ART"

"PRIOR ART"

"PRIOR ART"

"PRIOR ART"

"PRIOR ART"

SHEET-FED PRINTING PRESS CAPABLE OF PRINTING BOTH SIDES OF A SHEET

BACKGROUND OF THE INVENTION

1. Field of the Invention

The present invention relates to a sheet-fed printing press that is capable of selectively printing on a single side or both sides of a sheet, and more particularly, a cam-surface switching mechanism that is capable of selectively switching the cam surface, through which the driving of turn-over grippers on a sheet turn-over drum is controlled for switching to a single-side printing operation or a both-side printing operation.

2. Discussion of the Background

A sheet-fed printing press of the type is known in, for example, Japanese Examined Patent Publication (Kokoku) No. SHO-56-2017.

In the sheet-fed printing press according to the above-cited publication, a sheet transfer unit, as illustrated in FIG. 8, is provided between an upstream printing unit and a downstream printing unit so as to transfer sheets 1 from an impression cylinder (not shown) of the former to an impression cylinder 4 of the latter. Aligned in sequence from the upstream to the downstream of the sheet transfer unit are a transfer drum (not shown), a storage drum 2 and a turn-over drum 3. The sheets 1 printed at the upstream impression cylinder are transferred to the turn-over drum 3 via the transfer drum and the storage drum 2.

The turn-over drum 3 includes turn-over grippers 7 adapted to grip the leading or trailing edge of each sheet 1. The turn-over grippers 7 are constructed so that the sheet 1 is gripped through the associated operation of two gripping members 8 and 9 in each turn-over gripper 7. The thus constructed turn-over grippers 7 are pivotable around the pivoting axis extending parallel to the rotational axis of the turn-over drum 3, and have different functions respectively for a single-side printing operation and a both-side printing operation.

Specifically, in the single-side printing operation as illustrated in FIG. 9, the turn-over grippers 7 grip the leading edge of the oncoming sheet 1 at a tangential point A or a sheet receiving point between the storage drum 2 and the turn-over drum 3, enabling the turn-over drum 3 to receive the sheet 1 from the grippers 5 of the storage drum 2. The turn-over grippers 7 then rotate along with the turn-over drum 3 with maintaining their sheet gripping states, and transfer the sheet 1 to the impression cylinder 4 at a tangential point B or a sheet delivery point between the turn-over drum 3 and the impression cylinder 4. Then, the turn-over grippers 7 are pivoted through a predetermined angle according to the vectors 81 before reaching the tangential point A to be brought into a position as illustrated in FIG. 9, at which they grip the oncoming sheet 1.

On the other hand, in the both-side printing operation as illustrated in FIG. 10, following to the grippers 5 of each set on the storage drum 2 passing the tangential point A with maintaining their sheet gripping states, a corresponding sheet suction device 6 subsequently reaches the tangential point A at which the turn-over grippers 7 grip the trailing edge of the sheet 1, enabling the turn-over drum 3 to receive the sheet 1 from the storage drum 2. The grippers are then pivoted about the pivoting axis through about 180 degrees downstream with respect to the rotational direction of the turn-over drum 3 for the turning-over of the sheet 1, and then reach the tangential point B relative to the impression cylinder 4. The grippers 7 then deliver the sheet 1, which has been turned over, to the impression cylinder 4 at this point, and are pivoted through about 180 degrees towards upstream with respect to the rotational direction of the turn-over drum 3 to again have the free ends facing upstream at the tangential point A relative to the storage drum 2.

The turn-over grippers 7 performing the opening and closing actions, and the pivoting action each have the first gripping member 8 and the second gripping member 9, as described above. Specifically, the first gripping member 8 is firmly secured to a gripper shaft 10 having the common pivoting axis around which the grippers are pivoted, while the second gripping member 9 is firmly secured to a gripper tube 11 disposed coaxially on the gripper shaft 10 for supportingly receiving the gripper shaft 10. Gears 12 are respectively mounted on a first end of the gripper shaft 10 and a second end of the gripper tube 11 in meshing engagement with segment gears 13 disposed on the axially opposite sides of the turn-over drum 3.

The segment gears 13 are respectively supported on rotational pins 14 of the turn-over drum 3, and include cam followers 15 for driving the grippers. On the inner sides of a pair of flames 17 aligned at the axially opposite sides of the turn-over drum for supporting a drum shaft 16 of the turn-over drum 3 are respectively secured control cams 18 each having a torus shape with a hole defined therein through which the drum shaft 16 extends. Each control cam 18 has an outer circumference forming cam surfaces being engageable with a corresponding cam follower 15. Hence, the rotation of the turn-over drum 3 causes the cam followers 15 to respectively travel around the outer circumferences of the control cams 18, as sliding along the corresponding cam surfaces. Thus, the circumferential travel of the cam followers on the cam surfaces causes the segment gears 13 to travel around the rotational pins 14, so that the gripper shaft 10 and the gripper tube 11 are rotated via the gears 12, and hence the first gripping members 8 and the second gripping members 9 are controlled independently of each other.

Since the motion of the turn-over grippers 7 during the both-side printing operation is different from that during the single-side printing operation, the outer circumference of each control cam 18 forms two different cam surfaces arranged adjacent to each other along the axis of the turn-over drum 3. Specifically, the cam surfaces on each control cam 18 are respectively for the single-side printing operation and the both-side printing operation. Accordingly, the cam surfaces to be engaged with the corresponding cam followers 15 are selectively switched so as to adapt the motions of the first and second gripping members 8, 9 to the respective printing operations.

The switching of each cam surface is performed by manually displacing a corresponding cam follower 15 along the rotational center thereof, or along the axis of the turn-over drum 3, as represented in chain double-dashed line of FIG. 12. The same switching operation is performed at the opposite sides of the turn-over drum.

The thus arranged sheet-fed printing press requires a manual switching operation for the switching of the cam surfaces. To omit such a troublesome operation, attempts have been made to automatically perform the switching operation as disclosed in, for example, Japanese Unexamined Patent Publication (Kokai) No. HEI-07-24998. Specifically, this citation proposes the arrangement that, instead of the cam followers 15, the control cams 18 are displaced in the axial direction of the turn-over drum 3, which arrangement will be discussed in detail below with reference to FIG. 13.

The description will be made mainly for the switching mechanism at the right-hand side of the turn-over drum, since the switching mechanism of the opposite side of the turn-over drum is identical in structure thereto.

The drum shaft 16 of the turn-over drum 3 is supported by the flame 17 via a cylindrical bearing 19 whose part inwardly protrudes from the flame 17 and has an outer circumference on which the control cam 18 is loosely mounted in such a manner as to be displaceable in the axial direction of the turn-over drum 3. An air cylinder 20 for the displacement of the control cam 18 is disposed on the outer side of the flame 17 to generate the driving force in the vertical direction of the air cylinder 20 or the direction orthogonal to the axial direction of the turn-over drum 3. The thus generated driving force is then oriented in the axial direction of the turn-over drum 3 via the camming mechanism, enabling the control cam 18 to be displaced in the axial direction of the turn-over drum 3.

Since the air cylinder 20 is disposed opposite to the control cam 18 with the flame 17 therebetween, the control cam 18 is provided with two switching rods 21 extending through the cylindrical bearing 19. The two switching rods 21 are respectively and slidably disposed within guiding holes formed in the bearing 19, and have leading ends provided with switching cam followers 22. A pair of sliders 23 are also provided to be vertically moved by the air cylinder 20 via a link mechanism, and each forms therein a camming recess 24 extending slantingly with respect to the vertical direction for engagingly receiving a corresponding cam follower 22.

Accordingly, the vertical movement of the air cylinder 20 causes both the sliders 23 to vertically move through a predetermined distance via the link mechanism, which movement in turn causes the switching cam followers 22 to be displaced in the axial direction of the turn-over drum 3 towards the inner side or the outer side. Accordingly, the axial displacement of the control cam 18 via the switching rods 21 is caused, so that the cam surface to be engaged with the cam followers 15 is switched. Thus, the sheet-fed printing press can have the cam surfaces automatically switchable by the actuation of the air cylinder 20.

However, there causes somewhat movement or play between the switching rods 21 and the walls of the cylindrical bearing defining the guiding holes. This play may cause a slight displacement of the control cam 18 at the time of the completion of the switching operation. Specifically, the switching cam followers 22 are adapted to move in the axial direction of the turn-over drum 3 through the engagement with the camming recesses 24, so that the switching rods 21 may be displaced in the direction substantially orthogonal to the axial direction of the turn-over drum 3, and hence the control cam 18 may be displaced in that direction. Although the two switching rods 21 together act as a stopper for preventing the rotation of the control cam, the slight displacement of the switching rod within the guiding holes also causes the control cam to be slightly displaced in the circumferential direction of the bearing 19. In addition, since the cam followers 22 are disposed on the ends of the switching rods 21 having the lengthwise axis, the switching rods each may be bent into an arc.

In any case, the printing press of the conventional type as described above may cause the slight displacement of the control cam 18 due to the switching operation of the cam surfaces, which poses a problem of disrupting the smooth driving of the turn-over grippers 7, and hence a high precision registration.

In consideration of the, above problem, it is an object of the present invention to provide a sheet-fed printing press that is capable of achieving a high precision registration by limiting even a slight displacement of the control cam at the time of the completion of the switching operation involving the movement of the control cam for adapting the printing press either to the single-side printing operation or the both-side printing operation.

SUMMARY OF THE INVENTION

According to one aspect of the present invention, there is provided a sheet-fed printing press capable of printing on both sides of a sheet that includes a turn-over drum provided with turn-over grippers for gripping the sheet, control cams respectively disposed on the axially opposite sides of the turn-over drum in such a manner as to be displaceable in the axial direction of the turn-over drum, and cam followers for driving the turn-over grippers respectively disposed on the axially opposite ends of the turn-over drum. The control cams each have an outer circumferential surface forming thereon a cam surface for the single-side printing operation and a cam surface for the both-side printing operation, both the cam surfaces on each of the control cams being arranged adjacent to each other in the axial direction of the turn-over drum. The cam followers each are designed to travel around the outer circumference of a corresponding one of the control cams as sliding along one of the cam surfaces through the rotation of the turn-over drum, thereby controlling the motions of the turn-over grippers. The control cams are displaced in the axial direction of the turn-over drum, thereby enabling the cam followers to switch the cam surface to be engaged for switching to the single-side printing operation or to the both-side printing operation.

The printing press further includes stationary guide means for guiding the control cams in the axial direction of the turn-over drum, switching cam followers respectively provided on the control cams in such a manner as to protrude radially outwardly therefrom, sliders respectively forming therein camming recesses to be respectively engaged with the switching cam followers, and a slider driving means for reciprocatingly driving the sliders in such a manner as to enable the switching cam followers to reciprocatingly travel in the axial direction of the turn-over drum.

Accordingly, the switching cam followers each travel from a first end to a second end of a corresponding lone of the camming recesses along the longitudinal axis thereof for switching to the both-side printing operation, and each travel from the second end to the first end of the corresponding one of the camming recesses along the longitudinal axis thereof for switching to the single-side printing operation. The first and second ends along the longitudinal axis of each camming recess respectively have end wails adapted to press a corresponding one of the switching cam followers, so that the control cams are respectively biased against the stationary guide means in the direction substantially orthogonal to the axial direction of the turn-over drum at the time of completion of the switching operation.

According to the printing press having the above arrangement, when the printing press is to be switched from the single-side printing operation to the both-side printing operation, the slider driving means drives the sliders so that the switching cam followers each travel from the first end to the second end within the camming recess of the corresponding slider, and hence are displaced in the axial direction of the turn-over drum. The displacement of the switching cam followers 22 in the axial direction of the turn-over drum causes the control cams integrally arranged with the switching cam followers to be displaced in the axial direction of the turn-over drum, while being guided by the stationary guide means, and hence the cam surfaces for the both-side printing operation to be brought into a position at which the cam followers for driving the turn-over grippers are engageable therewith. In the state that the switching operation has been completed, the switching cam followers each are pressed via the end wall of the second end of the corresponding camming recess. The pressure applied to the switching cam followers causes the control cams to be respectively biased towards the stationary guide means in the direction substantially orthogonal to the axial direction of the turn-over drum, thereby reducing movement or play between the stationary guide means and the control cams.

Likewise, when switching to the single-side printing operation, the switching cam followers each are pressed via the end wall of the first end of the corresponding camming recess along the longitudinal axis thereof.

In the printing press having the above arrangement, the stationary guide means preferably includes guide members respectively disposed on the axially opposite sides of the turn-over drum to respectively provide abutments each having a longitudinal axis extending straight in the axial direction of the turn-over drum. The abutments each are adapted to be engaged with a corresponding one of the switching cam followers so that the control cams can be guided in the axial direction of the turn-over drum. The switching cam followers each are preferably adapted to be clamped between a corresponding one of the end walls of a corresponding one of the camming recesses and the abutment of a corresponding one of the guide members in the clamping direction substantially orthogonal to the axial direction of the turn-over drum at the time of completion of the switching operation.

According to another aspect of the present invention, there is provided a sheet-fed printing press capable of printing on both sides of a sheet including a turn-over drum provided with turn-over grippers for gripping the sheet, control cams respectively disposed on the axially opposite sides of the turn-over drum in such a manner as to be displaceable in the axial direction of the turn-over drum, and cam followers for driving the turn-over grippers respectively disposed on the axially opposite ends of the turn-over drum. The control cams each have an outer circumferential surface forming thereon a cam surface for the single-side printing operation and a cam surface for the both-side printing operation, both the cam surfaces on each of the control cams being arranged adjacent to each other in the axial direction of the turn-over drum. The cam followers each are designed to travel around the outer circumference of a corresponding one of the control cams as sliding along one of the cam surfaces through the rotation of the turn-over drum, thereby controlling the motions of the turn-over grippers. The control cams are displaced in the axial direction of the turn-over drum, thereby enabling the cam followers to switch the cam surface to be engaged for switching to the single-side printing operation or to the both-side printing operation.

The printing press further includes switching cam followers respectively provided on the control cams in such a manner as to protrude radially outwardly therefrom, sliders respectively forming therein camming recesses to be respectively engaged with the switching cam followers, a slider driving means for reciprocatingly driving the sliders in such a manner as to enable the switching cam followers to reciprocatingly travel in the axial direction of the turn-over drum, and guide members respectively providing abutments each having a longitudinal axis extending straight in the axial direction of the turn-over drum. The abutments each are adapted to be respectively engaged with a corresponding one of the switching cam followers so that the control cams can be guided in the axial direction of the turn-over drum.

Accordingly, the switching cam followers each travel from a first end to a second end of a corresponding one of the camming recesses along the longitudinal axis thereof for switching to the both-side printing operation, and each travel from the second end to the first end of the corresponding one of the camming recesses along the longitudinal axis thereof for switching to the single-side printing operation. The first and second ends along the longitudinal axis of each camming recess respectively have end walls adapted to press a corresponding one of the switching cam followers, so that the switching cam followers each are clamped between one of the end walls of a corresponding one of the camming recesses and a corresponding one of the guide members in the clamping direction substantially orthogonal to the axial direction of the turn-over drum.

According to the above arrangement, the switching cam followers travel along the camming recesses of the sliders, while being guided along the abutments of the guide members. Whereby, the driven point is matched to the guided point, so that the control cams can smoothly be displaced in the axial direction of the turn-over drum. In addition, since the switching cam followers each are clamped between the end wall of the corresponding camming recess and the corresponding guide member, even a slight movement of each control cam can be limited.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Figure 1:
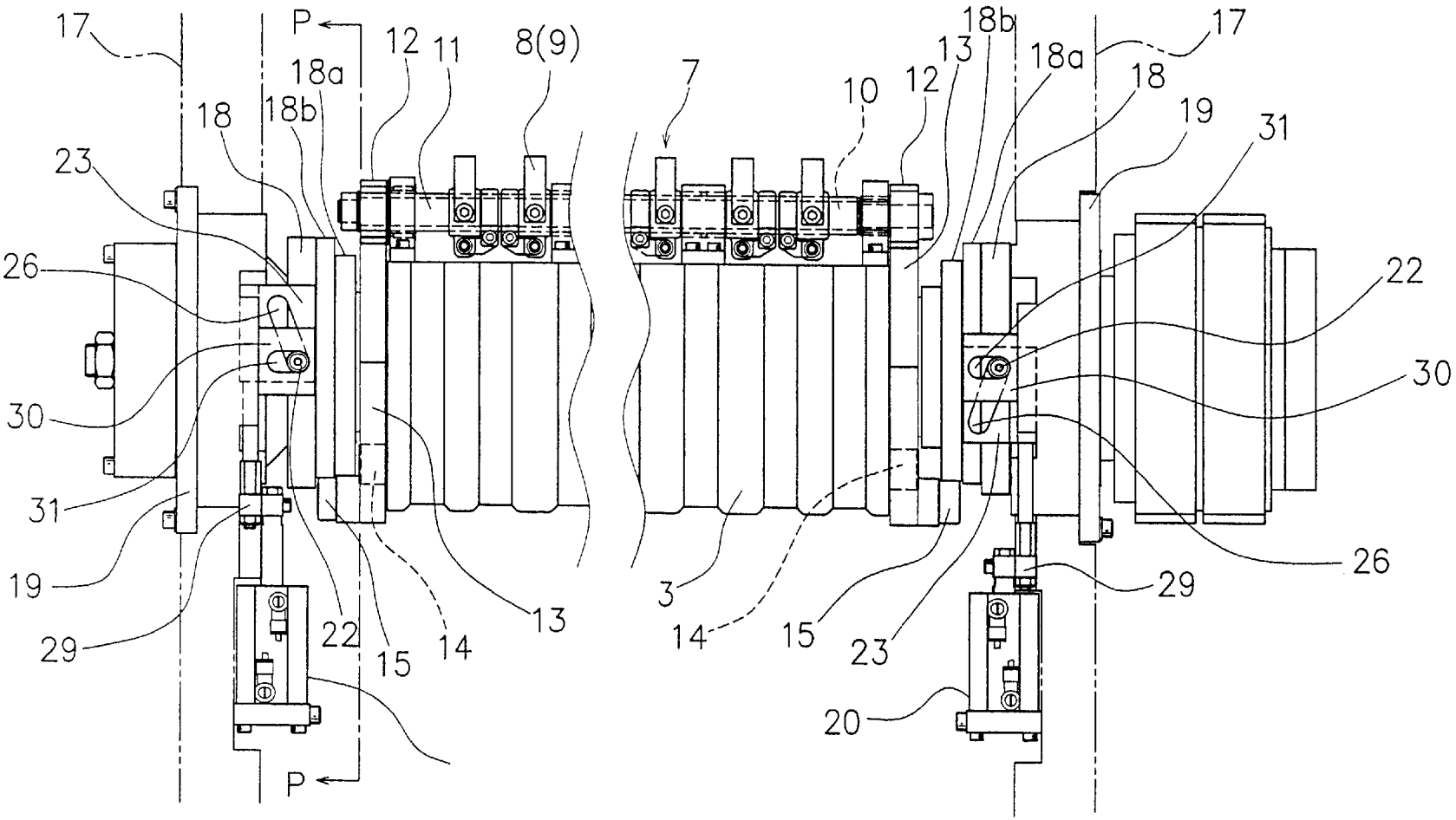
FIG. 1 is a schematic front view of an essential portion of the sheet-fed printing press capable of printing both sides of a sheet, according to one embodiment of the present invention.

An embodiment of the sheet-fed printing press capable of printing on both sides of the sheet according to the present invention will be hereinafter described with reference to FIGS. 1 to 5, in which corresponding or identical parts to those of the conventional printing press have been given the same reference characters to omit a detailed description thereof.

FIG. 1 is a front view of a turn-over drum 3 with omission of other parts or members. A drum shaft 16 of the turn-over drum 3 is supported on the cylindrical bearing 19 mounted on the pair of flames 17 (those represented in chain double-dashed line) disposed on the lateral sides or axially opposite sides of the turn-over drum 3. The drum shaft 16 ha s an extension extending outwardly from either flame 17 to receive a gear, through which the turn-over drum 3 is rotatable.

A row of the turn-over grippers 7 are aligned parallel to the drum shaft 16 of the turn-over drum 3, and has the first end (right end in FIG. 1) of the gripper shaft 10 and the second end (left end in FIG. 1) of the gripper tube 11, which are respectively provided with the gears 12. The turn-over drum 3 has the axially opposite ends provided with the segment gears 13 supported thereon via the rotational pins 14. The segment gears 13 are respectively meshed with the gears 12 of the gripper shaft 10 and the gripper tube 11. The segment gears 13 are respectively provided with the cam followers 15, each of which is positioned opposite to the turn-over grippers 7 with a corresponding rotational pin 14 as the center thereof to drive the turn-over grippers 7. The cam followers 15 for driving the turn-over grippers 7 each are structured in the form of a cam roller, which is positioned outside of a corresponding segment gear 13 with respect to the axial direction of the turn-over drum 3 and has a rotational center extending substantially parallel to the drum shaft 16 of the turn-over drum 3. The thus arranged cam followers 15 respectively travel along the cam surfaces of the control cams 18, as rolling thereon, so that the travelling load can be reduced.

In this embodiment, each of the axially opposite sides of the turn-over drum 3 is provided with the cam follower 15 and the control cam 18 so as to drive the gripper shaft 10 and the gripper tube 11 independently of each other and hence drive a pair of the first and second gripping members 8 and 9 in each turn-over gripper independently of each other. Each control cam 18 forms on the circumferential periphery cam surfaces 18*a* and 18*b* respectively for the both-side printing operation and the single-side printing operation, and is designed to be displaced in the axial direction of the turn-over drum 3 so as to switch the cam surface to be engaged by the corresponding cam follower 15 from 18*a* to 18*b* or vice versa.

Turning to FIG. 1, and specifically the control cam 18 at the left hand side thereof adapted to drive the gripper tube 11, aligned from the outside of the flame 17 in sequence are the cam surface 18*b* for the single-side printing operation, and the cam surface 18*a* for the both-side printing operation. On the other hand, the control cam 18 at the right hand side of FIG. 1, adapted to drive the gripper shaft 10, has a reverse arrangement. That is, the cam surface 18*a* for the both-side printing operation is positioned on the outside of the cam surface 18*b* with respect to the axial direction of the turn-over drum 3. Accordingly, when switching to the both-side printing operation, the control cam 18 of the left hand side is displaced outwardly, while the control cam 18 of the right hand side is displaced inwardly. When switching to the single-side printing operation, the control cam 18 of the left hand side is displaced inwardly while the control cam 18 of the right hand side is displaced outwardly. That is, both the control cams 18 are displaced in parallel in the same direction. However, it is a matter of course to employ a different arrangement where both the control cams 18 are displaced in parallel to the axis of the turn-over drum 3 towards the opposite sides or in a direction away from each other. FIG. 1 illustrates the control cams 18 positioned for the single-side printing.

Now, the description will be made for mechanisms disposed at the axially opposite sides of the turn-over drum 3, which enable the parallel displacement of the control cams 18 with respect to the axis of the turn-over drum 3. Since both mechanisms have the same arrangement, the description will be made in detail for the mechanism at the left hand side of FIG. 1.

Figure 2:
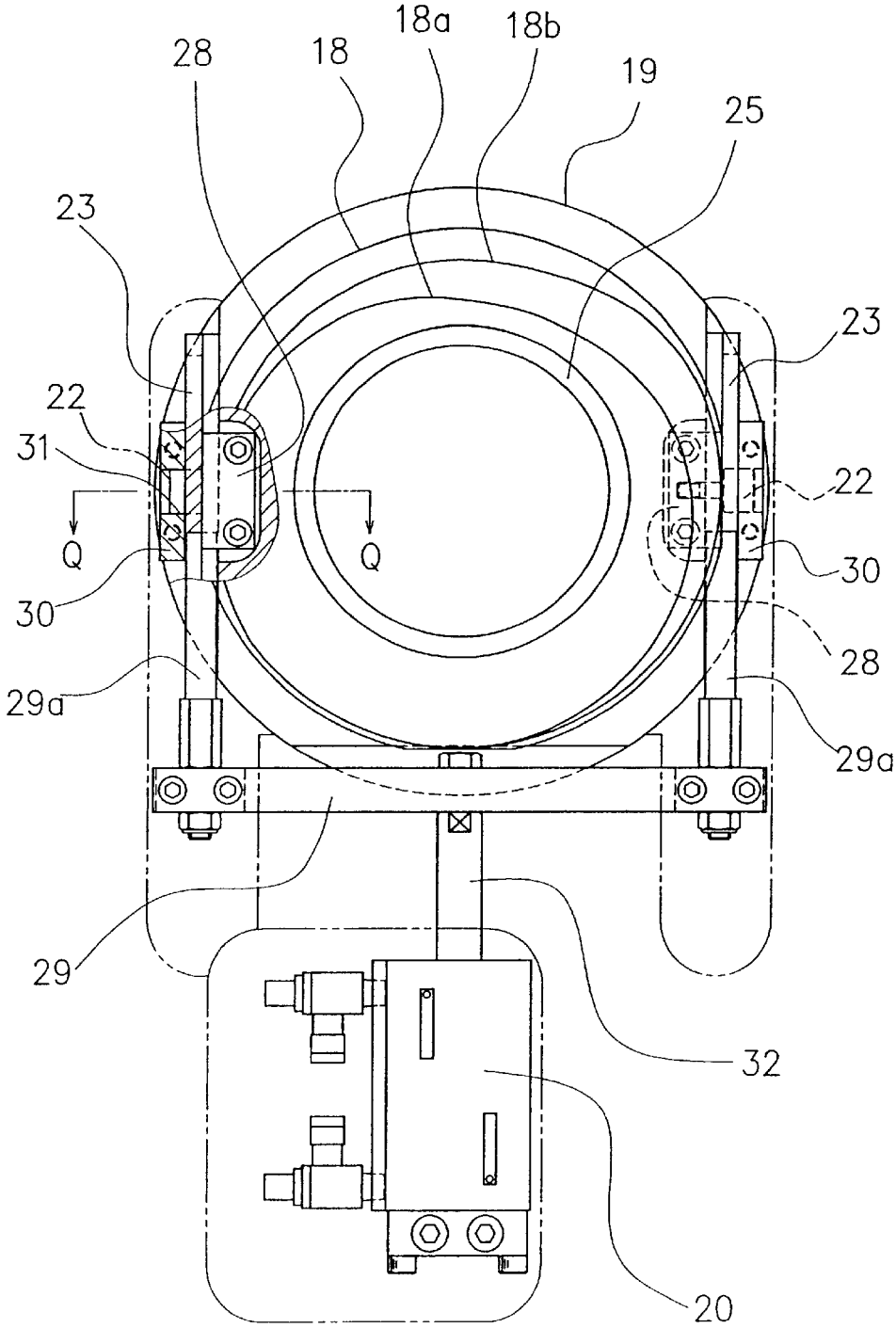
FIG. 2 is a schematic elevation partly in section as viewed from line P—P in FIG. 1.
Figure 3:
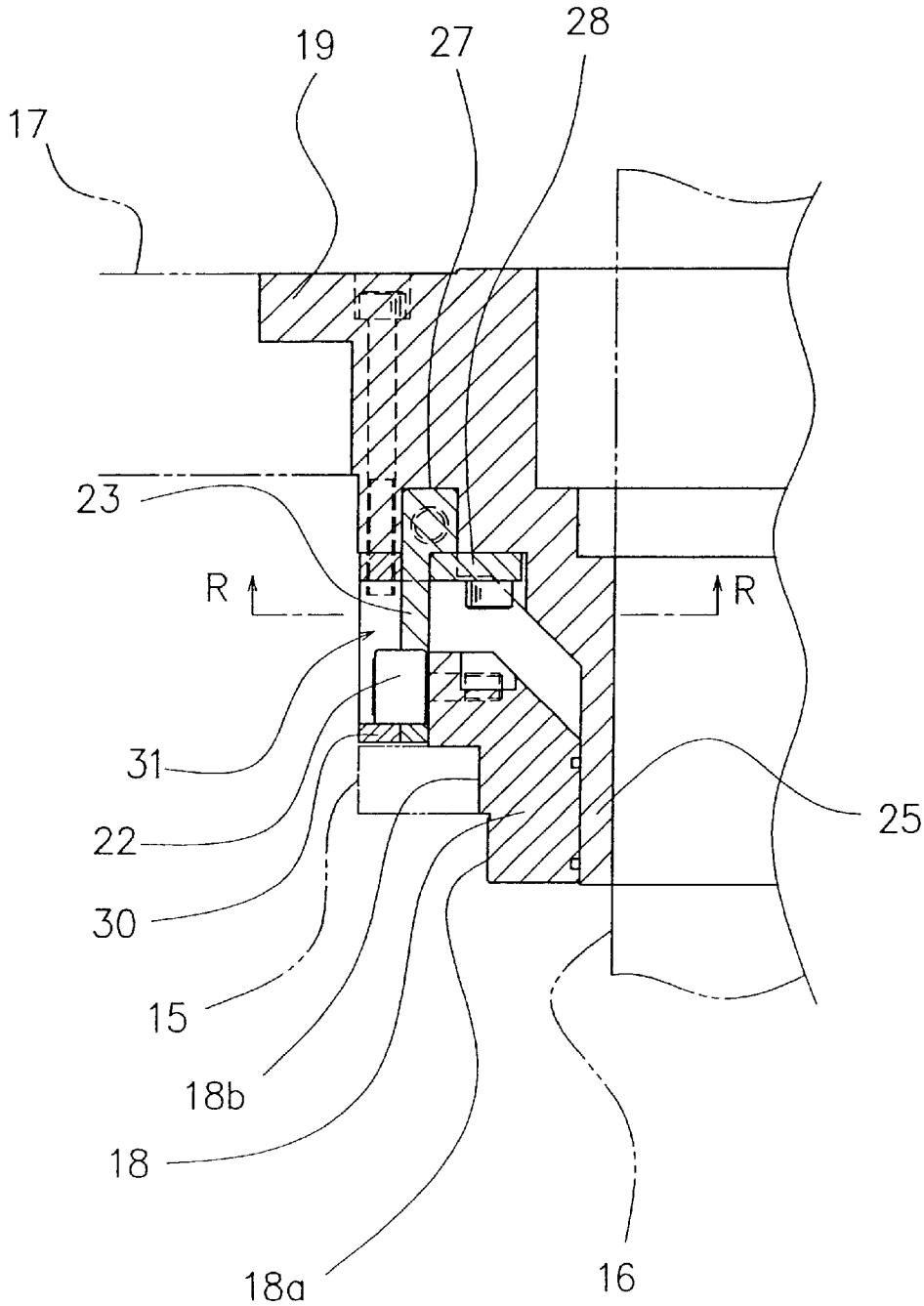
FIG. 3 is a schematic cross section taken along line Q—Q in FIG. 2.
Figure 4:
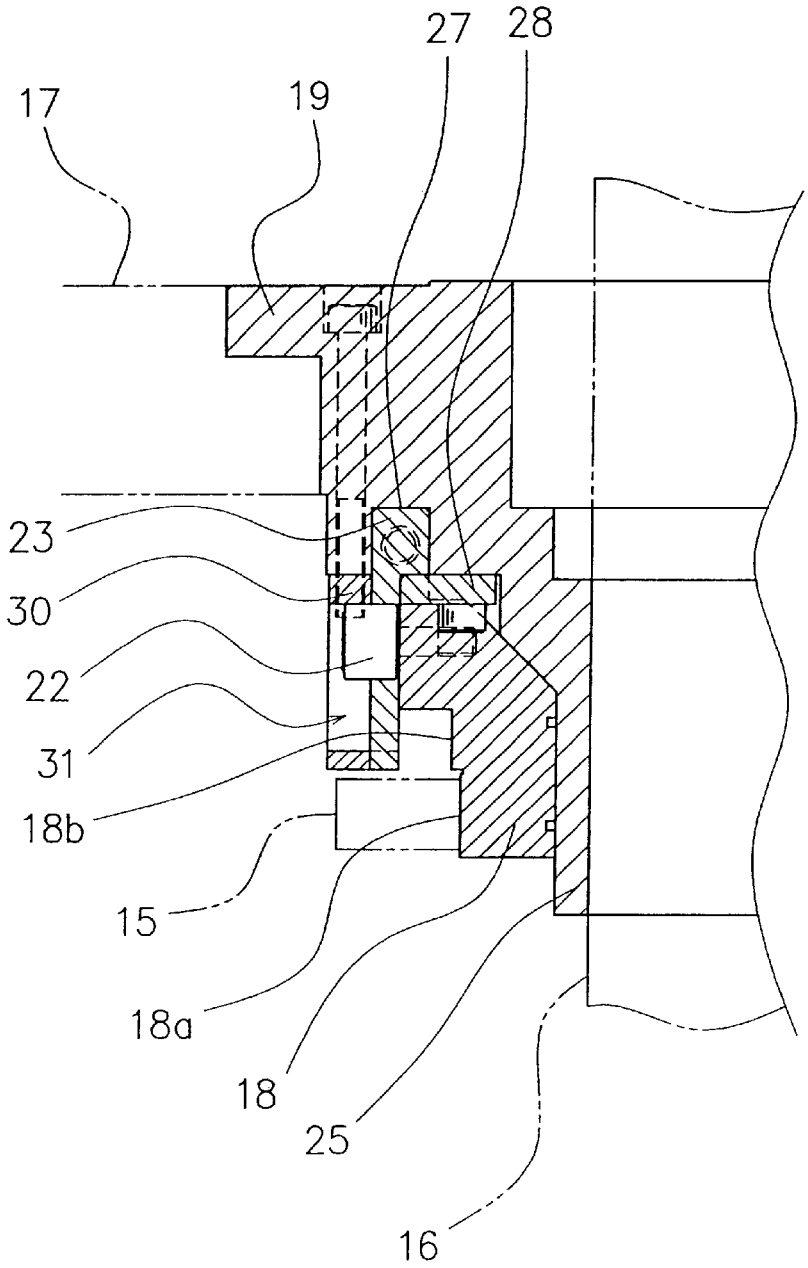
FIG. 4 is a schematic reference view showing the control cam which has been outwardly displaced from an engaging position shown in FIG. 3.
Figure 5A:
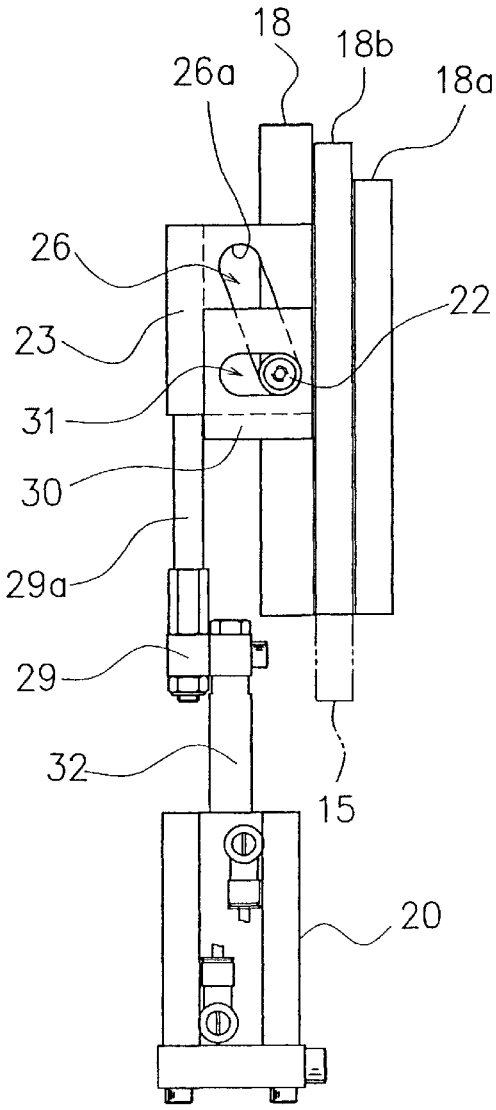
FIGS. 5A and 5B are schematic reference views of the essential portion of the printing press, the former illustrating the state corresponding to FIG. 3, and the latter illustrating the state corresponding to FIG. 4.
Figure 5B:
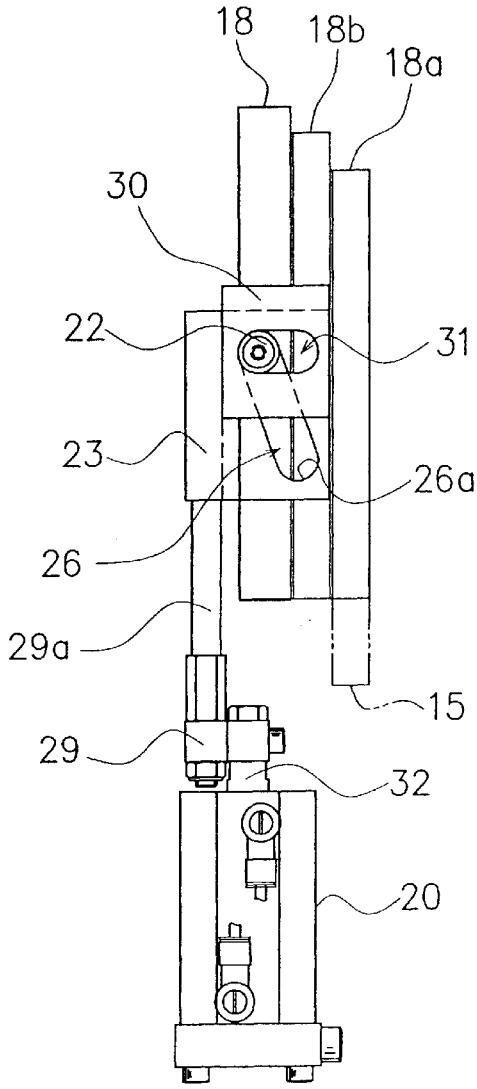

FIG. 2 is a schematic elevation partly in section as viewed from line P—P in FIG. 1. For easy understanding, only the cam surface switching mechanism enabling the parallel displacement of the control cam 18, the bearing 19, and the control cam 18 is shown. Specifically, the drum shaft 16 of the turn-over drum 3, the gripper tube 11, the cam follower 15 for driving the grippers, or other parts have been omitted. FIG. 3 is a schematic cross section taken along Q—Q in FIG. 2. FIG. 4 is a schematic reference,view showing the control cam 18 which has been outwardly displaced from an engaging position shown in FIG. 3, both views respectively showing the control cam 18 in the single-side printing operation and the both-side printing operation. The part in section of FIG. 2 corresponds to the part in section of FIG. 3 taken along line R—R. FIGS. 5A and 5B are schematic reference views showing only the control cam 18 and the cam surface switching mechanism as viewed from the front side. Specifically, FIG. 5A illustrates the control cam 18 which has been inwardly displaced and positioned closer to the turn-over drum 3 for the single-side printing operation, and FIG. 5B illustrates the control cam 18 which has been outwardly displaced away from the turn-over drum 3 for the both-side printing operation. Now, the description will be made with reference to FIGS. 2 to 5.

As illustrated in FIGS. 2 and 3, the cylindrical bearing 19 has a cylindrical guide member 25 projecting from the inner side of the flame 17 and coaxially arranged with the drum shaft 16. The cylindrical guide member 25 has its circumferential periphery, around which the control cam 18 formed entirely in a cylindrical shape is loosely mounted in such a manner to be axially displaceable with respect to the cylindrical guide member 25. That is, the drum shaft 16 of the turn-over drum 3 extends through the control cam 18. Both cam surfaces 18*a*, 18*b* are formed on the inner part of the circumferential periphery of the control cam 18, and positioned adjacent to each other. As used throughout the description, the directional term "inner" is relative to the turn-over drum 3 or the position closer to the turn-over drum 3, and "outer" is relative to the position away from the turn-over drum 3.

On the outer side of the cam follower in close proximity to the cam surface 18*b* is provided the switching cam follower 22 protruding radially outwardly therefrom. The switching cam follower 22 is also structured in the form of a cam roller whose rotational center extends in the radial direction of the control cam 18 and the direction substantially orthogonal to the axial direction of the turn-over drum 3.

The thus formed cam followers 22 are located substantially in a horizontal relationship with the printing press, and 180 degrees opposite to each other with the drum shaft 16 of the turn-over drum 3 as the center. Specifically, the cam followers 22 are respectively disposed at the opposite sides with respect to the travelling direction of the control cams 18 as viewed in plan.

On the other hand, sliders 23 each having a plate shape are mounted in a vertical position at the opposite sides with respect to the traveling direction of the control cam 18 as viewed in plan, and each define a driving slot 26 as a camming recess for the axial displacement of the control cams 18, which has a longitudinal axis extending straight in the vertical direction at an angle with respect to the axial direction of the turn-over drum 3. The switching cam followers 22 are respectively inserted into the driving slots 26 and engaged with the same. As illustrated in FIGS. 2 and 3, the sliders 23 are respectively engaged via their peripheral edges with cutouts 27 extending in the vertical direction of the bearing 19, and guided via their outer and inner sides by the bearing 19 and pressing plates 28 fastened to the bearing 19 via screws. That is, the sliders 23 are slidably guided in the vertical direction by the bearing 19 and the pressing plates 28.

Provided below the sliders 23 is a slider driving part as a slider driving means for reciprocatingly driving the sliders 23 in the vertical direction, or in the direction substantially orthogonal to the axial direction of the turn-over drum 3. The slider driving part includes a main shaft 32, an air cylinder 20 for moving the main shaft 32 forwards and rearwards, and a coupling member 29 coupled to the upper end of the vertically extending main shaft 32 and having an upper side forming a U-shaped recess. Thee air cylinder 20 is mounted on the inner side of the flame 17, and the coupling member 29 is located between the turn-over drum 3 and the flame 17. As illustrated in FIG. 2, the coupling member 29 includes a pair of vertically extending legs 29*a*, which are shaped to surround substantially a lower half of the control cam 18 and have upper ends respectively secured to the lower ends of the peripheral edges of the sliders 23.

Accordingly, through the forward and rearward motion of the main shaft 32 of the air cylinder 20, the sliders 23 are reciprocatingly and linearly moved in the vertical direction towards the same side. Since the driving slots 26 each have the longitudinal axis extending at an angle with respect to the driving direction of the sliders 23, the driving force oriented in the vertical direction of the air cylinder 20 is converted into the force oriented in the axial direction of the turn-over drum 3 via the driving slots 26 and the switching cam followers 22. Hence, the control cam 18 is guided along the cylindrical guide member 25 and moved parallel to the axis of the turn-over drum 3. Since the cam followers 15 for driving the grippers are not moved in the axial direction of the turn-over drum 3, the parallel motion of the control cams 18 with respect to the axial direction of the turn-over drum 3 enables the cam followers 15 to switch the cam surfaces from 18*a* to 18*b* or vice versa.

In each state of the sliders 23, that is, the uppermost position and the lowermost position of the sliders 23 as illustrated in FIGS. 5A and 5B, the cam followers 22 lie at the respective ends of the driving slots 26. For the both-side printing operation, the switching cam followers 22 travel upward within the driving slots 26 and abut the end walls 26*a* of the upper ends of the driving slots 26, while the air cylinder 20 applies the downwardly pulling force to the sliders 23 even after the switching cam followers 22 abut the end walls 26*a*. The switching cam followers 22 are thus secured in position on the end walls 26*a* of the upper ends of the driving slots 26, as illustrated in FIG. 5B. Likewise, in the single-side printing operation, the switching cam followers 22 are secured in position on the end walls 26*a* of the lower ends of the driving slots 26 with the sliders 23 pulled upwardly by the air cylinder 20, as illustrated in FIG. 5A.

The switching cam followers 22 respectively have end portions protruding outwardly from the driving slots 26 of the sliders 23 to be engaged with guide slots 31 of guide rails 30 as guide members mounted on the inner side of the bearing 19. As illustrated in FIG. 2, the guide rails 30 are disposed at the lateral sides of the bearing 19, and the guide slots 31 each have a longitudinal axis extending straight in the horizontal direction or the axial direction of the turn-over drum 3 to form an abutment with a corresponding switching cam follower 22. The guide rails 30 guide the switching cam followers 22 along the axis of the turn-over drum 3, and constitute stationary guide means for guiding the control cam 18 in the axial direction of the turn-over drum 3 in cooperation with the cylindrical guide member 25. In this regard, the guide rails 30 may be provided on the laterally inner sides of the sliders 23.

As described above, the switching cam followers 22, which have been pressed upwards or downwards via the end walls 26*a* of the driving slots 26 of the sliders 23 at the time of the completion of the switching operation, are biased to either the upper end walls or the lower end walls of the guide slots 31. Specifically, the switching cam followers 22 each are clamped between the end wall 26*a* of the corresponding driving slot 26 and the corresponding guide rail 30 in the clamping direction substantially orthogonal to the axial direction of the turn-over drum 3. Hence, the control cam 18 is biased upwards or downwards with respect to the cylindrical guide member 25.

Both the guide rails 30 also act as a rotation stopper of the control cam 18 and more specifically act to prevent the control cam 18 from rotating with respect to the cylindrical guide member 25 in the circumferential direction thereof. As illustrated in FIGS. 3 to 5, the switching cam followers 22 each lie substantially at either the inner end or the outer end of the guide slot 31 of the corresponding guide rail 30 at the time of the completion of the switching operation.

As described above, the control cam 18 and the cam-surface switching mechanism at the right hand side of the turn-over drum 3 in FIG. 1 perform the same operation as those at the left hand side except for the air cylinder 20, which is moved in the opposite direction to that of the air cylinder 20 of the left hand side.

Now, the description will be made for the operation of the thus arranged printing press by taking for example the case where it is switched from the single-side printing operation as illustrated in FIG. 1 to the both-side printing operation.

The air feeding to both the air cylinders 20 are switched so that the air cylinder at the left hand side is moved from the ejected position to the retracted position, while the air cylinder at the right hand side is moved from the retracted position to the ejected position. According to these positional changes of the air cylinders 20, the sliders 23 are moved straight in the vertical direction, while the switching cam followers 22 each are moved from the first end to the second end of the corresponding driving slot 26 as guided by the guide slot 31 of the corresponding guide rail 30. The parallel movements of the switching cam followers 22 with respect to the axial direction of the turn-over drum 3 towards the left hand side in FIG. 1 enable the control cam 18 to move towards the left hand side integrally with the switching cam followers 22. That is, the control cams 18 are guided by the cylindrical guide members 25 and the guide rails 30 respectively disposed at the lateral sides of each cylindrical guide member 25, thereby enabling the secured parallel movements 6of the control cams 18.

When the switching cam followers 22 each have reached the second end of the corresponding driving slot 26, the control cam 18 at the left hand side is biased downwardly towards the cylindrical guide member 25 and both the guide rails 30, while the control cam 18 at the right hand side is biased upwardly towards the same. Therefore, movement or play between the inner circumferential surface of the control cam 18 and the outer circumferential surface of the cylindrical guide member 25, movement or play between the switching cam follower 22 and the guide slot 31, or the like is prevented, with the result that the control cams 18 can be fixed in position and kept in a stabilized manner. Accordingly, the cam followers 15 can run over the cam surfaces 18*a* for the both-side printing operation without jounce action, enabling the highly accurate registration. The switching operation to the single side printing operation can also be performed in the same manner.

Since the switching cam followers 22 respectively serving as driving-force acting points at the axially opposite sides of the turn-over drum 3 each are clamped between the guide rail 30 and the end wall 26*a* of the driving slot 26 of the corresponding slider 23 from above and below, the control cams 18 are kept in position in more stabilized manner with arresting even a slight motion thereof in the circumferential direction. It is a matter of course that the smooth travelling of the control cams 18 can be achieved by guiding the switching cam followers 22 via the guide rails 30.

Since the switching cam followers 22 and the sliders 23 are respectively located about 180 degrees opposite to each other with the axis of the turn-over drum as the center, the control cams 18 can more smoothly be displaced as compared with the switching mechanism with those members located at a single location, and exhibit positional stability after the switching operation. Where a plurality of the switching cam followers 22 are disposed at different positions and are to be respectively driven by the sliders 23 in the manner as described above, it is preferable to couple the sliders 23 together via the coupling member 29 so as to be driven by a single air cylinder 20 or the like towards the same side.

Since the switching cam followers 22 are directly mounted on the control cam 18 unlike the prior switching rod, associated switching parts or members each are not bent into an arc. In addition, a simplified structure can be achieved by the arrangement with the slider driving part located between the flames 17.

Moreover, the sliders 23, which reciprocatingly move in a straight line substantially orthogonal to the axial direction of the turn-over drum 3, and the driving slots 26, each of which has a longitudinal axis extending straight along the driving direction of the sliders 23 with an inclination of a predetermined angle towards the axial direction of the turn-over drum 3 can achieve a simplified mechanism, which enables the cam followers 22 to be displaced in the axial direction of the turn-over drum 3. In addition, the sliders 23 whose driving direction is oriented substantially orthogonal to the axial direction of the turn-over drum 3 enables the switching cam followers 22 to be easily and securely pressed in the direction substantially orthogonal to the axial direction of the turn-over drum 3 via the end walls 26*a* of the driving slots 26, so that the control cams 18 can more securely be positioned. Also, the clamping of the switching cam followers 22 between the end walls 26*a* and the guide rails 30 can simply and securely be performed.

It is possible to employ various driving means in place of the air cylinders 20 to drive the sliders 23. The sliders 23 may be designed to be reciprocatingly moved in a straight line with an, inclination of a predetermined angle with respect to the vertical direction, or to be reciprocatingly moved along an arc, resembling the swing of pendulum. It is also possible to suitably modify the design of the stationary guide means.

Figure 6A:
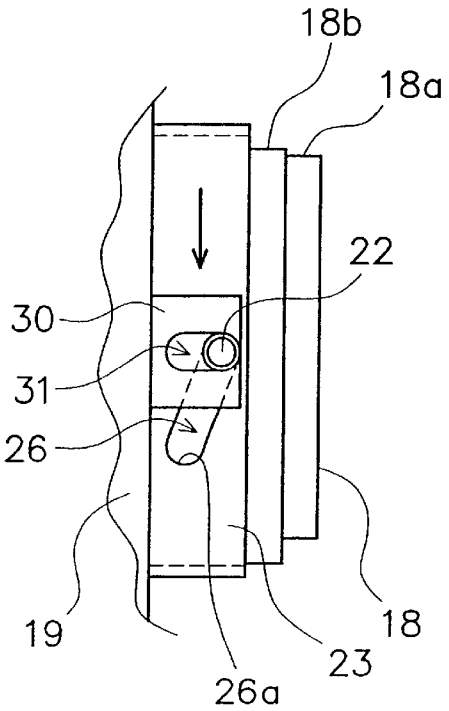
FIGS. 6A and 6B are respectively schematic reference views of an essential portion of the sheet-fed printing press with the air cylinder in ejected state, according to another embodiment of the present invention.
Figure 6B:
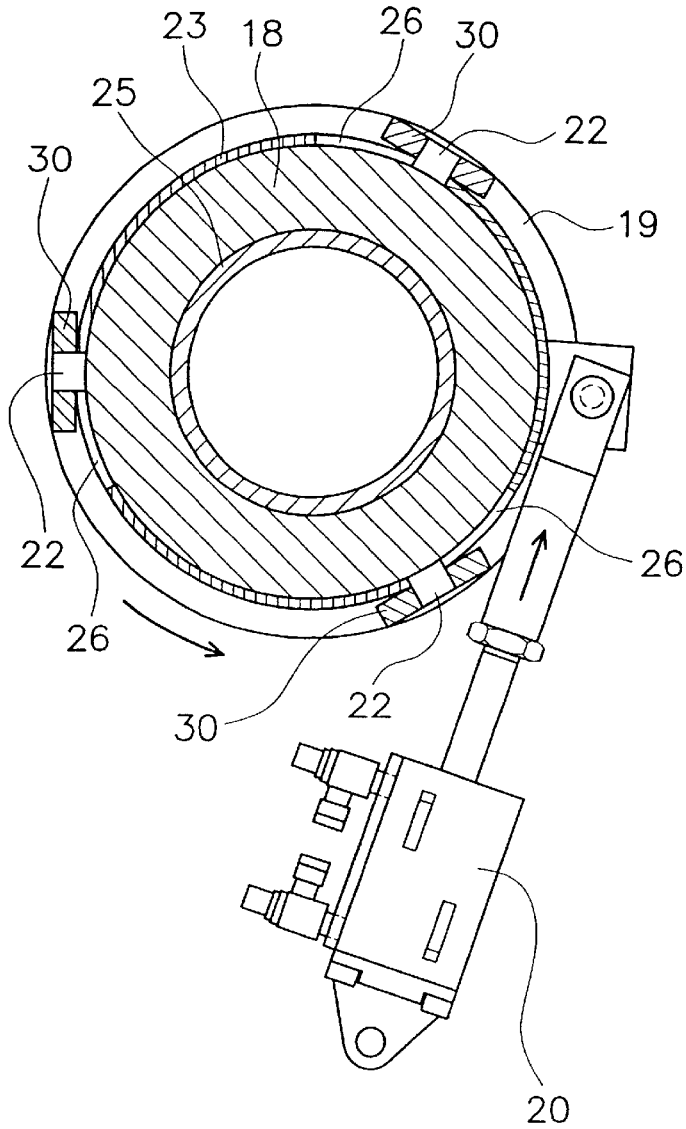
Figure 7A:
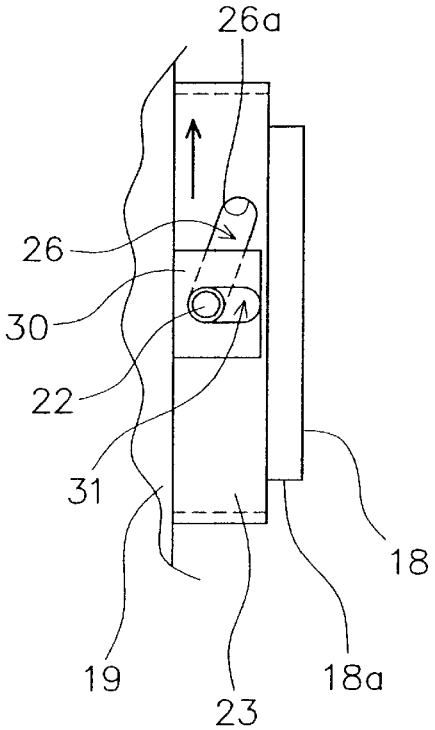
FIGS. 7A and 7B are respectively schematic reference views of the essential portion of the sheet-fed printing press with the air cylinder in retracted state.
Figure 7B:
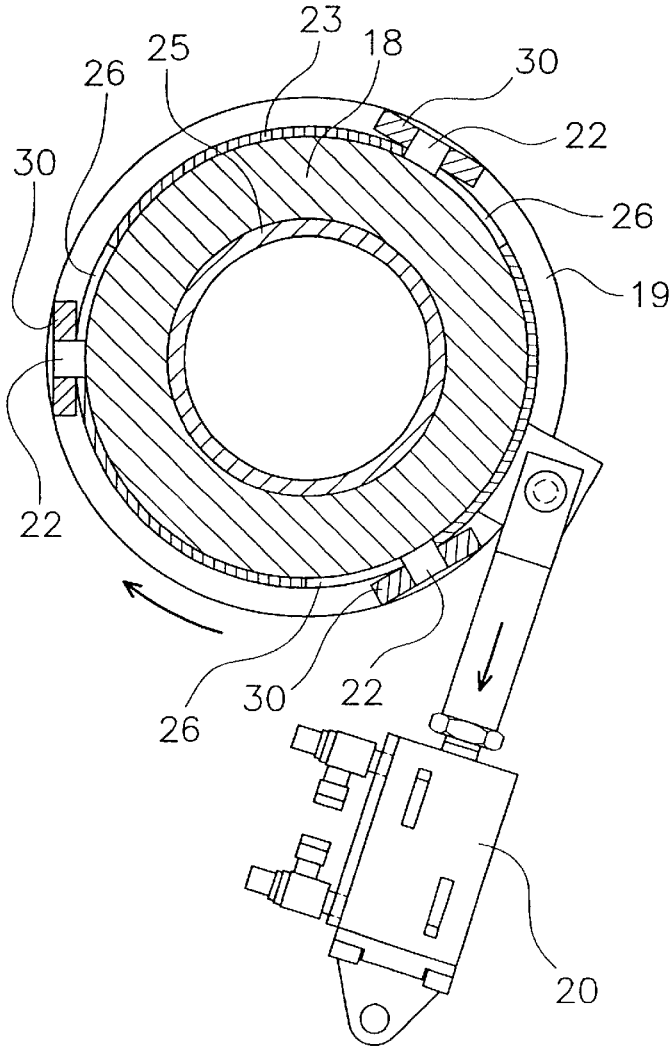
Figure 8:
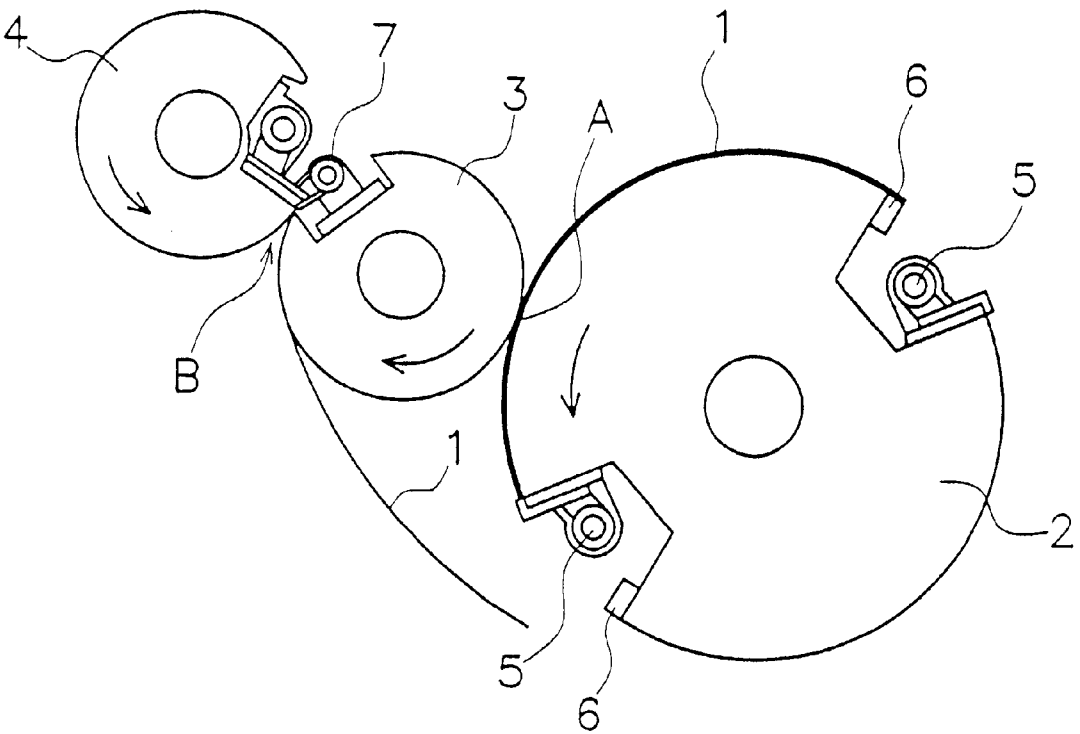
FIG. 8 is a schematic reference view of an essential portion of a conventional printing press.
Figure 9:
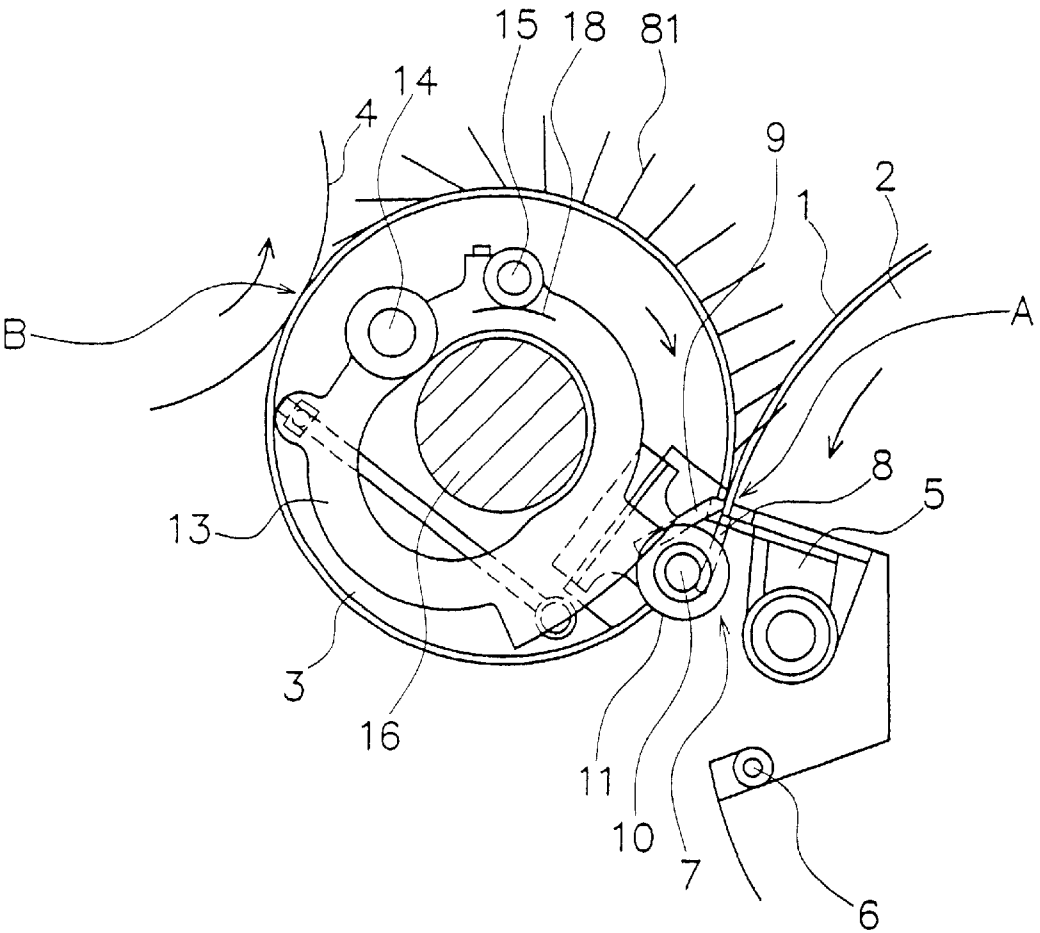
FIG. 9 is a schematic reference view of the essential portion of the printing press during the single-side printing operation.
Figure 10:
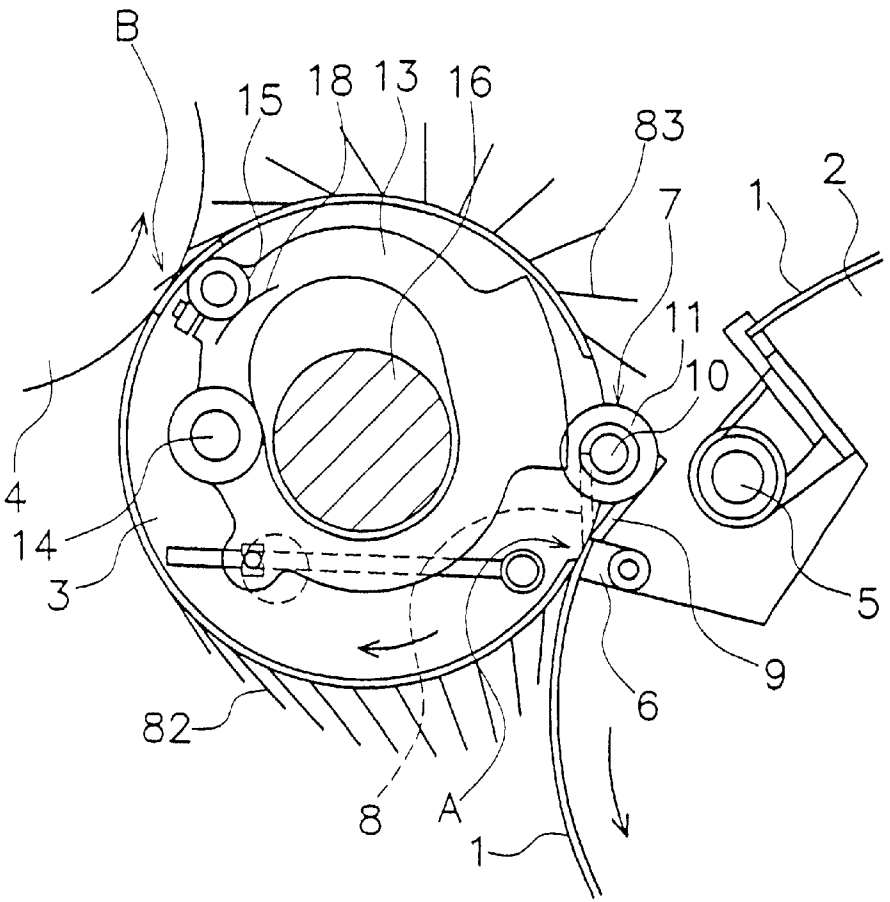
FIG. 10 is a schematic reference view of the essential portion of the printing press during the both-side printing operation.
Figure 11:
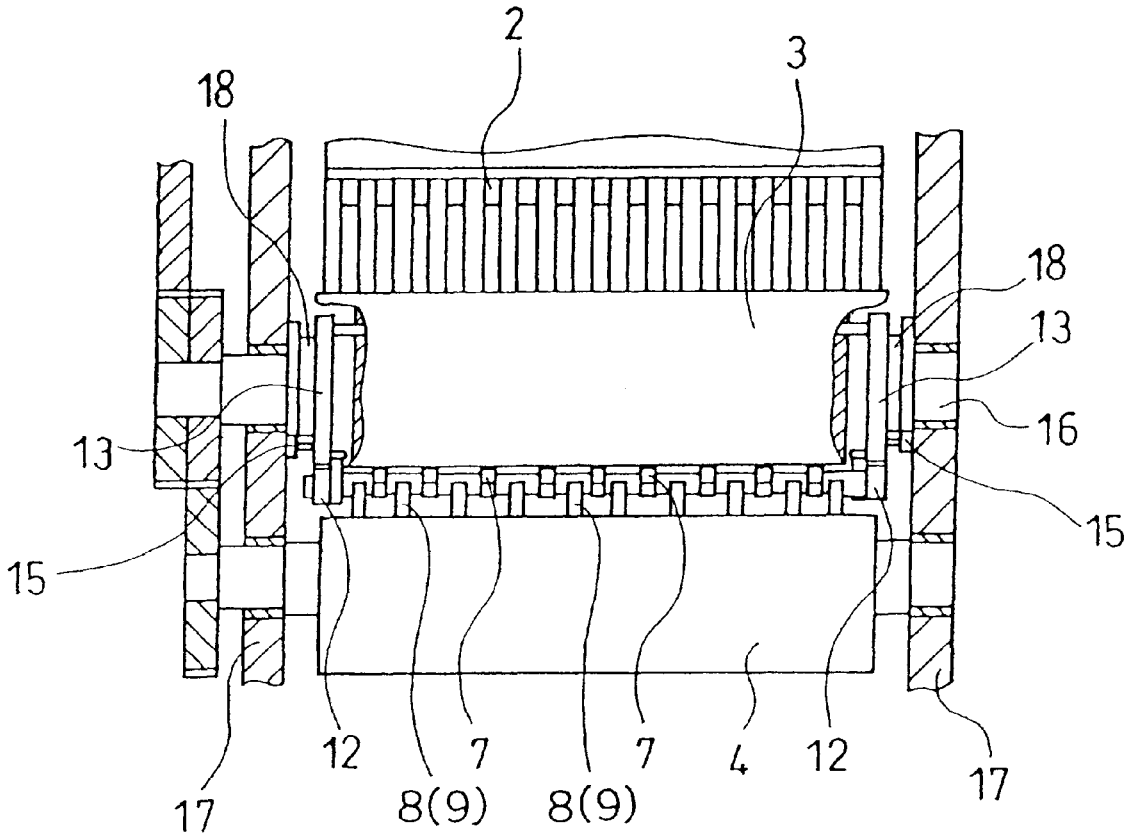
FIG. 11 is a schematic plan view in section of the essential portion of the printing press.
Figure 12:
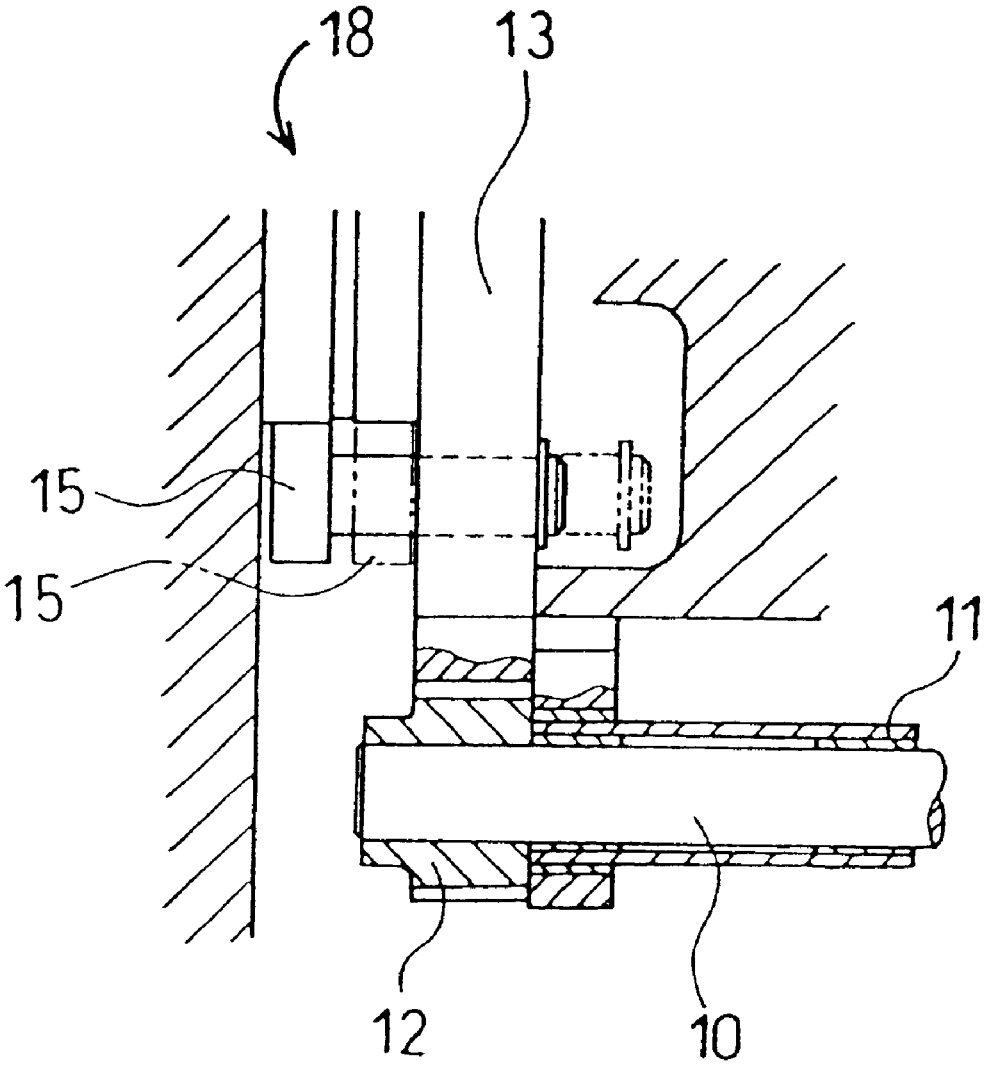
FIG. 12 is an enlarged view of the essential portion of FIG. 11.
Figure 13:
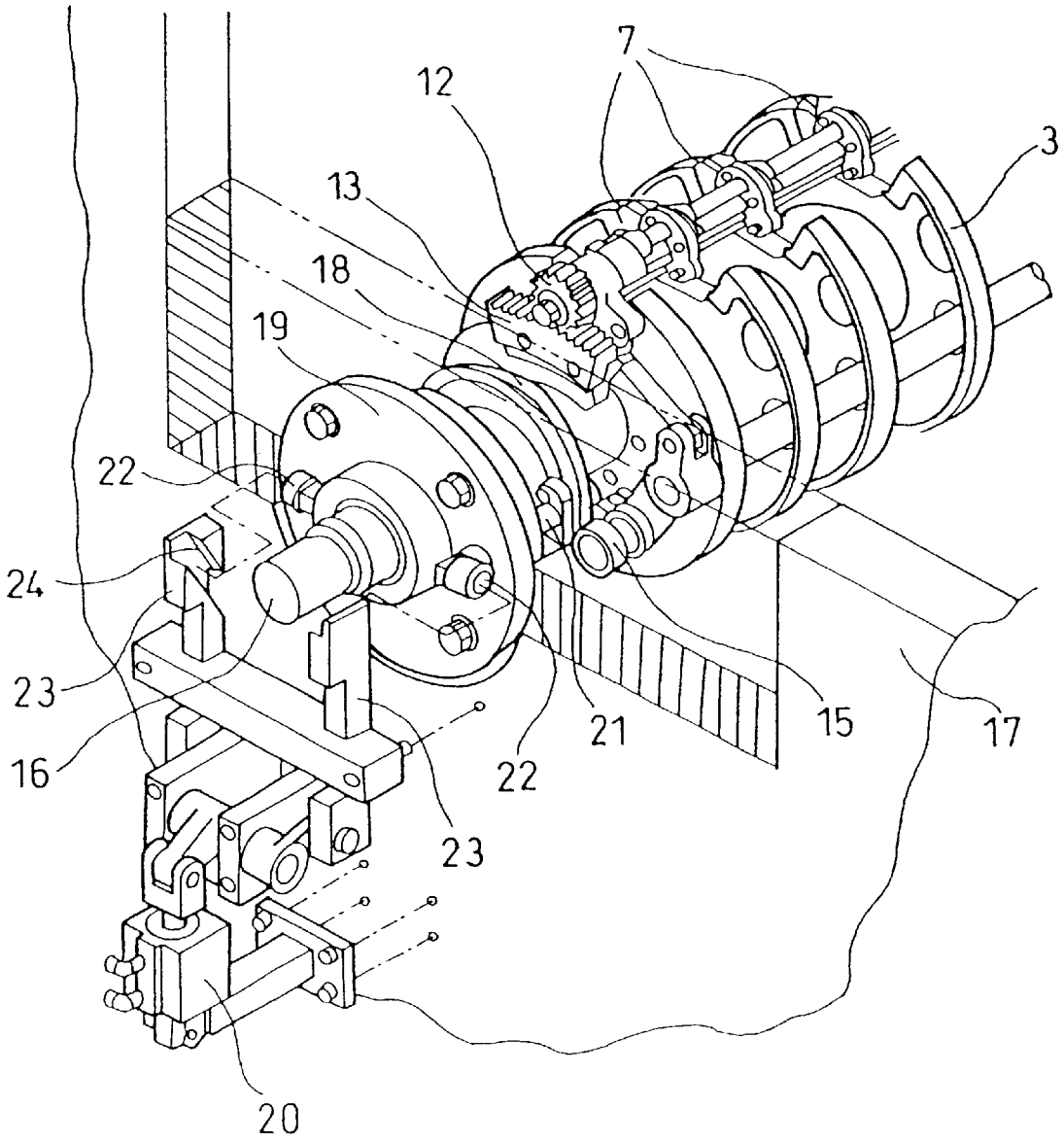
FIG. 13 is a schematic perspective view of another type of the conventional printing press.

FIGS. 6 to 7 illustrate the switching mechanism having a different arrangement. Specifically, both the sliders 23 at each of the axially opposite sides of the turn-over drum 3 are integrally formed into a ring which is loosely mounted around the control cam 18, while the guide rails 30 having the aforementioned arrangement are disposed at predetermined along the outer periphery of the slider 23, so that the ring-shaped slider 23 is reciprocatingly moved about the axis of the turn-over drum 3, thereby enabling the switching cam followers 22 to be moved in the direction parallel to the axis of the turn-over drum 3. Specifically, three switching cam followers 22 are disposed on the control cam 18 evenly or with spacing of about 120 degrees to each other, and the ring-shaped slider 23 correspondingly forms therein three driving slots 26 each having a longitudinal axis inclined by a predetermined angle with respect to the circumferential direction of the slider. The guide rails 30 having the guide slots 31 are respectively disposed outside of the slider 23, and the air cylinder 20 is selectively ejected and retracted to rotate the ring-shaped slider 23, and hence displace the control cam 18 towards a predetermined side.

According to the above arrangement, the switching cam followers 22 are biased in the tangential direction with respect to the guide slots 31 or in the direction substantially orthogonal to the axial direction of the turn-over drum 3. As is apparent from this, it is possible to clamp the switching cam followers 22 between the end walls 26*a* of the driving slots 26 and the ring-shaped guide rail 30 in the clamping direction substantially orthogonal to the axial direction of the turn-over drum 3. It is also possible to employ two or more switching cam followers (e.g., three switching cam followers) at each of the axially opposite sides of the turn-over drum 3, so that the control cam 18 can more securely be fixed in position.

In the above embodiment, the description was made for the control cam 18 whose outer circumferential surface defines therein both the cam surfaces 18*a* and 18*b* for the both-side printing operation and the single-side printing operation. Alternatively, both cam surfaces may be formed respectively in separately formed control cams 18.

It is also possible to employ the arrangement where the sliders 23 are respectively provided with the switching cam followers 22, and the control cams 18 respectively form therein the camming recesses 26.

As described above, since even a slight motion of the control cams of the printing press according to the present invention can be arrested every time the completion of the switching operation is completed, it is possible to prevent the deterioration of the registration accuracy caused by the switching of the control cam, thereby accomplishing a higher precision registration as compared with the conventional arrangement.

In the above embodiments, the control cams 18 are disposed on the axially opposite sides of the turn-over drum 3. However, a control cam having the same construction of each of the control cams 18 may be disposed on either side of the axially opposite sides of the turn-over drum 3.

This specification is by no means intended to restrict the present invention to the preferred embodiments set forth therein. Various modifications to the sheet-fed printing press, as described herein, may be made by those skilled in the art without departing from the spirit and scope of the present invention as defined in the appended claims.

What is claimed is:

1. A sheet-fed printing press capable of printing on both sides of a sheet comprising:

a turn-over drum provided with turn-over grippers for gripping the sheet;

control cams respectively disposed on the axially opposite sides of said turn-over drum in such a manner as to be displaceable in the axial direction of the turn-over drum, said control cams each having an outer circumferential surface forming thereon a cam surface for the single-side printing operation and a cam surface for the both-side printing operation, both the cam surfaces on each of said control cams being arranged adjacent to each other in the axial direction of the turn-over drum;

cam followers for driving said turn-over grippers respectively disposed on the axially opposite ends of the turn-over drum, said cam followers each being designed to travel around the outer circumference of a corresponding one of said control cams as sliding along one of said cam surfaces through the rotation of the turn-over drum, thereby controlling the motions of the turn-over grippers, wherein said control cams are displaced in the axial direction of the turn-over drum, thereby enabling said cam followers to switch the cam surface to be engaged for switching to the single-side printing operation or to the both-side printing operation;

stationary guide means for guiding said control cams in the axial direction of the turn-over drum;

switching cam followers respectively provided on the control cams in such a manner as to protrude radially outwardly therefrom;

sliders respectively forming therein camming recesses to be respectively engaged with said switching cam followers;

a slider driving means for reciprocatingly driving the sliders in such a manner as to enable the switching cam followers to reciprocatingly travel in the axial direction of the turn-over drum, wherein said switching cam followers each travel from a first end to a second end of a corresponding one of said camming recesses along the longitudinal axis thereof for switching to the both-side printing operation, and each travel from said second end to said first end of said corresponding one of said camming recesses along the longitudinal axis thereof for switching to the single-side printing operation, and said first and second ends along the longitudinal axis of each camming recess respectively have end walls adapted to press a corresponding one of said switching cam followers, so that the control cams are respectively biased against the stationary guide means in the direction substantially orthogonal to the axial direction of the turn-over drum at the time of completion of the switching operation.

2. A sheet-fed printing press according to claim 1, wherein said stationary guide means includes guide members respectively disposed on the axially opposite sides of said turn-over drum to respectively provide abutments each having a longitudinal axis extending straight in the axial direction of the turn-over drum and being adapted to be engaged with a corresponding one of said switching cam followers so that said control cams can be guided in the axial direction of the turn-over drum; and said switching cam followers each are adapted to be clamped between a corresponding one of the end walls of a corresponding one of said camming recesses and the abutment of a corresponding one of said guide members in the clamping direction substantially orthogonal to the axial direction of the turn-over drum at the time of completion of the switching operation.

3. A sheet-fed printing press capable of printing on both sides of a sheet comprising:

a turn-over drum (3) provided with turn-over grippers (7) for gripping the sheet;

control cams respectively disposed on the axially opposite sides of said turn-over drum in such a manner as to be displaceable in the axial direction of the turn-over drum, said control cams each having an outer circumferential surface forming thereon a cam surface for the single-side printing operation and a cam surface for the both-side printing operation, both the cam surfaces on each of said control cams being arranged adjacent to each other in the axial direction of the turn-over drum;

cam followers for driving said turn-over grippers respectively disposed on the axially opposite ends of the turn-over drum, said cam followers each being designed to travel around the outer circumference of a corresponding one of said control cams as sliding along one of said cam surfaces through the rotation of the turn-over drum, thereby controlling the motions of the turn-over grippers, wherein said control cams are displaced in the axial direction of the turn-over drum, thereby enabling said cam followers to switch the cam surface to be engaged for switching to the single-side printing operation or to the both-side printing operation;

switching cam followers respectively provided on the control cams in such a manner as to protrude radially outwardly therefrom;

sliders respectively forming therein camming recesses to be respectively engaged with said switching cam followers;

a slider driving means for reciprocatingly driving the sliders in such a manner as to enable the switching cam followers to reciprocatingly travel in the axial direction of the turn-over drum;

guide members respectively providing abutments each having a longitudinal axis extending straight in the axial direction of the turn-over drum and being adapted to be engaged with a corresponding one of said switching cam followers so that said control cams can be guided in the axial direction of the turn-over drum, wherein said switching cam followers each travel from a first end to a second end of a corresponding one of said camming recesses along the longitudinal axis thereof for switching to the both-side printing operation, and each travel from said second end to said first end of said corresponding one of said camming recesses along the longitudinal axis thereof for switching to the single-side printing operation, and said first and second ends along the longitudinal axis of each camming recess respectively have end walls adapted to press a corresponding one of said switching cam followers, so that the switching cam followers each are clamped between one of the end walls of a corresponding one of the camming recesses and a corresponding one of the guide members in the clamping direction substantially orthogonal to the axial direction of the turn-over drum at the time of completion of the switching operation.

4. A sheet-fed printing press capable of printing on both sides of a sheet comprising:

a turn-over drum provided with turn-over grippers for gripping the sheet;

at least one control cam disposed on either one of the axially opposite sides of said turn-over drum in such a manner as to be displaceable in the axial direction of the turn-over drum, said at least one control cam having an outer circumferential surface forming thereon a cam surface for the single-side printing operation and a cam surface for the both-side printing operation, both the cam, surfaces on said at least one control cam being arranged adjacent to each other in the axial direction of the turn-over drum;

a cam follower for driving said turn-over grippers disposed on said either one of the axially opposite ends of the turn-over drum, said cam follower being designed to travel around the outer circumference of said at least one control cam as sliding along one of said cam surfaces through the rotation of the turn-over drum, thereby controlling the motions of the turn-over grippers, wherein said at least one control cam is displaced in the axial direction of the turn-over drum, thereby enabling said cam follower to switch the cam surface to be engaged for switching to the single-side printing operation or to the both-side printing operation;

stationary guide means for guiding said at least one control cam (18) in the axial direction of the turn-over drum;

a switching cam follower provided on said at least one control cam in such a manner as to protrude radially outwardly therefrom;

a slider respectively forming, therein a camming recess to be respectively engaged with said switching cam follower;

a slider driving means for reciprocatingly driving the slider in such a manner as to enable the switching cam follower to reciprocatingly travel in the axial direction of the turn-over drum, wherein said switching cam follower travels from a first end to a second end of said camming recess along the longitudinal axis thereof for switching to the both-side printing operation, and each travel from said second end to said first end of said camming recess along the longitudinal axis thereof for switching to the single-side printing operation, and said first and second ends along the longitudinal axis of said camming recess respectively have end walls adapted to press said switching cam follower, so that the control cam is biased against the stationary guide means in the direction substantially orthogonal to the axial direction of the turn-over drum at the time of completion of the switching operation.

5. A sheet-fed printing press according to claim 4, wherein said stationary guide means includes a guide member respectively disposed on said either one of the axially opposite sides of said turn-over drum to provide an abutment having a longitudinal axis extending straight in the axial direction of the turn-over drum and being adapted to be engaged with said switching cam follower so that said at least one control cam can be guided in the axial direction of the turn-over drum; and said switching cam follower, is adapted to be clamped between a corresponding one of the end walls of said camming recess and the abutment of said guide member in the clamping direction substantially orthogonal to the axial direction of the turn-over drum at the time of completion of the switching operation.

* * * * *